United States Patent [19]

Nourry

[11] Patent Number: 4,731,510

[45] Date of Patent: Mar. 15, 1988

[54] CIRCUIT-BREAKER WITH TRIPPING LEVER COOPERATING WITH MOVABLE CONTACT SUPPORT MEMBER HAVING A RESILIENT BLADE WHICH EFFECTS CONTACT OPENING AND CLOSURE

[75] Inventor: Daniel Nourry, Dijon, France

[73] Assignee: La Telemecanique Electrique, France

[21] Appl. No.: 882,001

[22] Filed: Jul. 3, 1986

[30] Foreign Application Priority Data

Jul. 19, 1985 [FR] France ..... 85 11076

[51] Int. Cl.[4] ..... H01H 1/44; H01H 1/50

[52] U.S. Cl. ..... 200/275; 200/290; 200/153 G; 200/245; 200/271; 335/196

[58] Field of Search ..... 200/290, 275, 245, 246, 200/250, 271, 272, 325, 153 G, 153 H, 153 SC, 6 R, 67 D, 287; 335/196, 15

[56] References Cited

U.S. PATENT DOCUMENTS

| | | | |
|---|---|---|---|
| 1,779,659 | 10/1930 | Carichoff | 200/290 X |
| 2,443,047 | 6/1948 | McClain | 200/290 |
| 2,788,421 | 4/1957 | Jones | 200/290 |
| 2,802,922 | 8/1957 | Page et al. | 200/290 X |
| 3,313,904 | 4/1967 | Chambaut | 200/278 X |
| 3,594,521 | 7/1971 | Roll et al. | 200/67 D X |
| 4,472,701 | 9/1984 | Bellows et al. | 200/153 G X |
| 4,488,018 | 12/1984 | Hayashida | 200/6 R |

FOREIGN PATENT DOCUMENTS

| | | | |
|---|---|---|---|
| 2574987 | 6/1986 | France | 200/153 G |

*Primary Examiner*—Henry J. Recla
*Assistant Examiner*—Ernest G. Cusick
*Attorney, Agent, or Firm*—William A. Drucker

[57] ABSTRACT

The support piece of a circuit-breaker's movable contact assembly has a one piece structure including a rigid sole piece carrying the mobile contacts and a resilient blade facing the sole piece, at a distance therefrom, and forming a contact pressure spring.

6 Claims, 8 Drawing Figures

CIRCUIT-BREAKER WITH TRIPPING LEVER COOPERATING WITH MOVABLE CONTACT SUPPORT MEMBER HAVING A RESILIENT BLADE WHICH EFFECTS CONTACT OPENING AND CLOSURE

BACKGROUND OF THE INVENTION

1. Field of the Invention

The present invention relates to a protective switching apparatus of the circut breaker kind including in as isolating case an interruptible current path in which is disposed at least one pair of cooperating contacts one of which is fixed and the other of which is mobile in response to the actuation either of an electromagnetic or thermal tripping member, or of a voluntary tripping member, via a lock.

2. Description of the Prior Art

As is known from the French patent application No. 84 19043 filed on the Dec. 13, 1984 in the name of the applicant for: "Protective switching apparatus", the mobile contact of the circuit breaker is disposed at a first end of a contact carrying rocker arm made from an electrically conducting material, and the second end of which is associated with a retractable bearing surface forming the outlet member of the lock; in addition, the contact carrying arm is under the control of the action of a resilient means, such as a torsion spring in the form of a hair pin, serving for opening and closing the mobile contact.

In this mechanism, the two particular functions mentioned above, respectively support of the mobile contact and opening-closing of said mobile contact, are fulfilled respectively by two separate mechanical pieces, namely the rocker arm on the one hand and the hair pin spring on the other. However, the fact of using two separate pieces dependent on each other, that is to say acting one on the other, for fulfilling these two functions has the drawback of complicating their relative arrangement for setting and tripping the circuit breaker.

On the other hand, since the rocker arm of this mechanism is associated, on the side of its end opposite that carrying the mobile contact with the lock of the circuit breaker itself associated with the electromagnetic and/or thermal tripper, the current path established between the terminals of the circuit breaker passes then through the whole length of the contact carrying arm, which forms a drawback in that the arm risks being subjected to changes of state, particularly by heating and oxidization, which may result in poor operation of the setting and tripping mechanism of the circuit breaker; to overcome this drawback, problems arise, generally delicate, in the choice of material for the contact carrying rocker arm.

SUMMARY OF THE INVENTION

The purpose of the present invention is to overcome these drawbacks by proposing one and the same piece, used in the setting and tripping mechanism of a circuit breaker in particular, which fulfills both the function of supporting the mobile contact or contacts as well as the function of closing this or these mobile contact or contacts, while also allowing opening thereof. These two particular functions, which are in fact related to one another, are then henceforth grouped together in a single mechanical piece, whence a certain simplification in the construction of the mechanism of the circuit breaker.

It is therefore an one object of the invention to provide a circuit-breaker operable under the effect of a current overload, said circuit breaker including:

i. at least one stationary contact member and at least one movable contact member respectively having contact surface portions adapted for mutual engagement;

ii. a support member for the movable contact member, said support member having a resilient blade portion;

iii. tripping means for pivoting the support member from a biased position of the resilient blade portion in which said contact surface portions are mutually engaged to a released position in which said contact surface portions are separated from each other and resetting means for pivoting the support member from the released position to the biased position;

iv. said tripping means comprising an elongate lever pivotally mounted about a displaceable axis which is movable from a first position to a second position, said lever having at a first end thereof a pin adapted for engaging the resilient blade portion, said lever cooperating at a second end thereof with latching means releasable under the effect of said current overload, said latching means having a latch which has, relative to said lever, a released position in which said second end of the lever is freed and a latching position in which said second end of the lever is latched, said latch then forming a further pivoting axis for said lever, said tripping means further comprising spring means engaging on a surface portion of said lever which is located between said pin and said displaceable axis for pivoting the lever in a first direction about said displaceable axis when said displaceable axis is in its first position and the latch passes to its released position whereby the pin is disengaged from the the resilient blade portion which then returns to its released position;

v. said resetting means, in the released position of said latch, being operable through manual action to move said displaceable axis from its second to its first position and automatically returning siad displaceable axis to its second position when no manual action is exerted thereon, said latching means further comprising means for moving the latch to the latching position when the current overload has disapeared, said lever, when said manual action is exerted for resetting the support member to its biased position, pivoting about said displaceable axis in said first direction until the latch has recaptured the second end of the lever and then pivoting about a further axis in said second direction opposite the first direction, whereby the pin engages the resilient blade portion which then is biased to its biased position.

A feature of this invention is that said contact support piece resides in the fact that said piece has a one piece structure comprising a rigid part carrying the mobile contact or contacts and a resilient part of the spring blade type serving for closing this or these mobile contact or contacts and providing a suitable so called contact pressure.

Fitted into a circuit breaker, the support piece of the invention also has the advantage of not forming part of the path followed by the electric current between the terminals of the circuit breaker, thus simplifying the choice of material for said piece.

BRIEF DESCRIPTION OF THE DRAWINGS

Other characteristics and advantages of the invention will be clearer from the detailed description which follows with reference to the accompanying drawings given solely by way of example and in which.

DESCRIPTION OF THE PREFERRED EMBODIMENT

Figure 1:
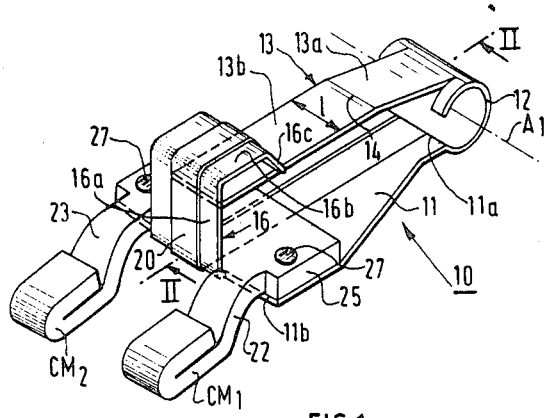
FIG. 1 shows in perspective the support piece for two mobile contacts in accordance with the invention.

In FIG. 1, there is shown at 10 a support piece for two mobile contacts $CM_1$ and $CM_2$, in accordance with the invention, intended to be used in a control mechanism particularly a protective switching apparatus of the circuit breaker kind.

As is known, the purpose of the control mechanism of the circuit breaker is, on the one hand, to cause closure of the electric contacts by applying the or each mobile contact to a fixed associated contact and, on the other hand, to cause opening of these contacts by separating the or each mobile contact from its fixed associated contact either following a defect of electric origin, short circuit or electric overload, or by voluntary tripping It will also be mentioned that in FIG. 1 has been shown solely by way of illustration and in no way limiting two mobile contacts supported by the contact carrying piece; of course, this latter may support only a single mobile contact, without departing from the scope of the invention.

If we exclude the two contacts illustrated in FIG. 1, the support piece properly speaking, made for example from steel, is profiled as a single piece in several parts of particular shapes obtained by conventional mechanical operations such as stamping, rolling and bending.

Thus, piece 10 is formed first of all of a rigid flat sole piece 11 of a general shape defined by a rectangle two corners of which, symmetrical with respect to the longitudinal axis of the rectangle, each have been eliminated by a short cut parallel to this axis, followed by a long oblique cut.

Sole piece 11 is extended, on its smallest lateral edge 11a, by a part 12 rolled into a cylinder portion with axis $A_1$ perpendicular to the longitudinal direction of the sole piece. This cylinder part 12 serves as connection between the sole piece 11 and a flexible resilient blade 13 forming a contact pressure spring and coming opposite the sole piece at a distance therefrom.

The spring blade 13, in FIG. 1, has a rectangular shape substantially of the same length as the sole piece and has a portion 13*a* connected tangentially to the cylindrical part 12 at a central position thereof. Blade 13 is, on the other hand, bent slightly at 14 so that its portion 13*b*, in the absence of elastic deformation, is disposed parallel to the sole piece 11 at the lever of the central part thereof.

Figure 2:
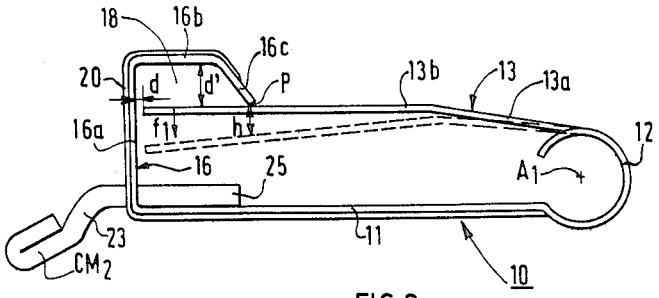
FIG. 2 shows a view through line II—II of FIG. 1, illustrating the two positions in which the resilient blade may take.

From the middle of its lateral edge 11b parallel to and opposite the one contiguous to the cylindrical part 12, the sole piece 11 is extended by a rigid rectangular central tongue, referenced as a whole at 16, of a width slightly greather than that l of the spring blade 13 and profiled so as to have three following successive branches: a first branch 16*a* bent perpendicularly to the longitudinal direction of the sole piece 11 and coming opposite the free end of the spring blade 13, at a small distance d therefrom (FIG. 2); a second branch 16*b*, bent parallel to the longitudinal direction of said sole piece and overlapping the spring blade 13, at a distance d' therefro in its rest position illustrated with continuous lines in FIG. 2; and a third branch 16*c* curved in the direction of the spring blade so that its end comes to bear at P (FIG. 2) on the upper face of the spring blade 13, transversally with respect thereto, when said blade is in the rest state.

It will be noted that, with the spring blade 13 in the rest position, the part of its branch 13*b* which is situated under the roof formed by the bent parts of the tongue 16, defines therewith a space 18 (FIG. 2) in which a mechanical piece may move, as will be seen further on.

As is clear from FIGS. 1 and 2, the support piece 10 also comprises a continuous stiffening molding 20 serving for increasing the inertia of said piece and extending longitudinally along the middle portion of the outer faces of the rigid parts of the contact support piece, namely the sole piece 11 and the three branches 16*a*, 16*b* and 16*c* forming the tongue 16.

The two mobile contacts $CM_1$ and $CM_2$ in FIG. 1 are formed identically respectively at one of the ends of two slightly curved parallel arms 22 and 23 disposed projecting in the longitudinal direction of the sole piece 11 on each side of the central tongue 16; these two arms are connected transversely to each other by a plate 25 which is fixed by any appropriate means, as for example by two rivets 27, for example to the upper face of sole piece 11, towards the edge thereof. It will be noted that the two contacts $CM_1$ and $CM_2$, as well as the two arms 22 and 23 and plat 25, are made from an electrically conducting material, from copper for example, and preferably form one and the same piece.

From the preceding description, it may be concluded that the support piece of the invention has the following main feature: said piece is formed, on the one hand, of a rigid part 11 carrying the mobile contact or contacts and, on the other hand, a resilient part 13 forming a contact pressure spring.

In greater detail, in connection with the spring blade 13 a predetermined force $f_1$ (FIG. 2) may be exerted thereon which tends to cause it to bend, as illustrated with broken lines in FIG. 2, over a height h defined with respect to its rest position at bearing point P; in its working position, said blade therefore applies a certain pressure for closing the mobile contacts on their fixed associated contacts.

Figure 3:
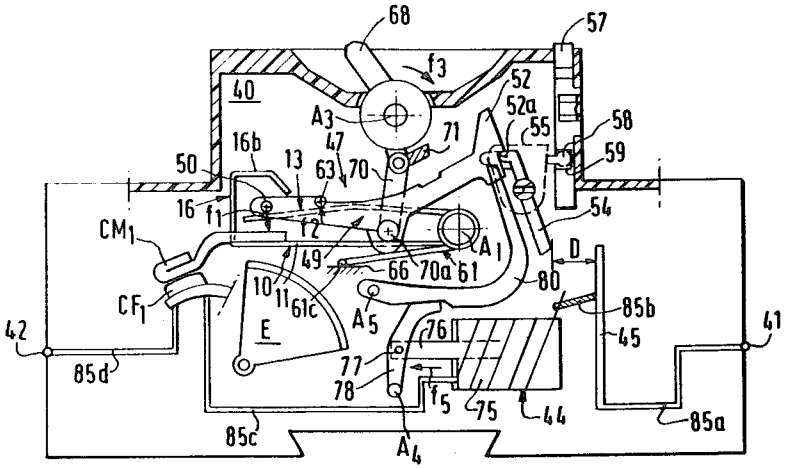
FIG. 3 shows schematically, in elevation, the main components of the circuit breaker in the set position and in which the mechanism for controlling the contacts includes the support piece.

FIG. 3 shows in elevation a protectve switching apparatus whose mechanism for controlling the contacts includes the support piece of the invention such as described above with reference to FIGS. 1 and 2.

This apparatus is a module circuit breaker with insulating case 40, having two pairs of separable contacts, only the pair of which formed by the mobile contact $CM_1$ and its associated fixed contact $CF_1$ is visible in FIG. 3, disposed in a current path provided in the case between a first terminal 41 and a second terminal 42.

Case 40 includes an electromagnetic tripping member referenced as a whole at 44, and a thermal bimetallic strip 45, capable of actuating a lock 47 so as to separate the two mobile contacts from the two fixed associated contacts, following a defect of electric origin, short circuit or electric overload, appearing at terminals 41 and 42.

The structure of the lock 47 of the circuit breaker using the support piece 10 of the invention will now be described with reference to FIGS. 3 and 4.

Besides the contact carrying piece 10 already described mounted in the case on the fixed axis $A_1$, lock 47 also includes a lever forming piece 49 in the form of a cradle, with axis XX' having two longitudinal parallel arms 49*a* and 49*b* (FIG. 4) connected transversely to each other, on the one hand, to a first end, by a pin 50 with axis $A_2$ and, on the other hand, to a second end, opposite the first one, by a so called tripping piece 52 having a shoulder 52*a* (FIG. 3).

When the circuit breaker is in the set position, as illustrated in FIG. 3, the pin 50 of lever 49 comes to bear on the spring blade 13 of the contact carrying piece 10, transversely with respect to said blade, and exerts thereon the downward force $f_1$ which tends to cause it to bend as was seen in connection with FIG. 2, whereas and end of a lever 54 comes to bear against shoulder 52*a* of the tripping piece 52.

This lever 54, FIG. 3, is carried by a support 55 cooperating with a rotary wheel 57 accessible from outside the case and having graduations corresponding to diffrent direct or relative values of the thermal tripping current, through a finger 58 engaged in groove 59 formed in the wheel.

Figure 4:
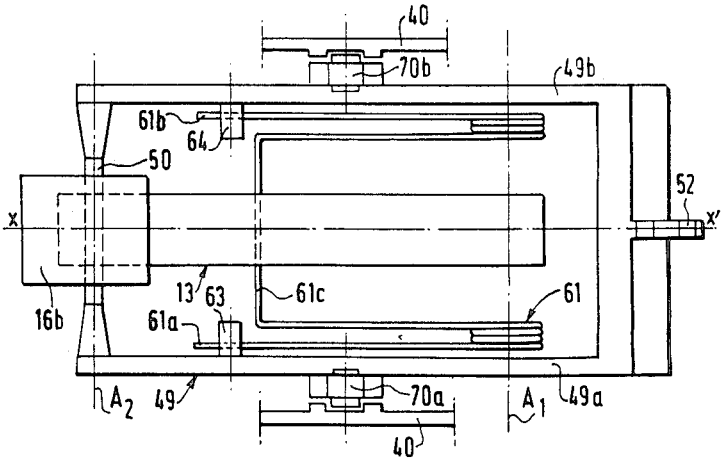
FIG. 4 shows a top view of this contact control mechanism.

As can be seen in FIG. 4, lever 49 is fixed to a double hair pin spring 61 mounted on the fixed axis $A_1$ and whose two free ends 61*a* and 61*b* come respectively into abutment underneath two coaxial cylindrical studs 63 and 64 mounted respectively perpendicularly on the two arms 49*a* and 49*b* of the lever; these spring ends are capable of exerting on each of the studs of lever 49 an upward force $f_2$ illustrated in FIG. 3. In addition, the hair pin spring 61 has a branch 61c bent transversely with respect to the axis XX' (FIG. 4) and coming to rest on a stop 66 (FIG. 3) provided in the case 40.

In FIG. 3, a so called voluntary tripping member such for example as a pivoting handle 68, with fixed axis $A_3$, is associated with the front face of case 40 of the circuit breaker and is urged conventionally by a spring not shown which tends to cause it to pivot in the direction of arrow $f_3$ about its axis $A_3$.

Handle 68 is, on the other hand, connected to lever 49 by a toggle connection 70 coming to rest, in the set position (FIG. 3), on a stop 71 provided in case 40 and ending in two bearing points 70*a* and 70*b* firmly secured respectively to two arms 49*a* and 49*b* of the lever 49 (FIG. 4) and able to move each one in a guide slot formed in case 40.

As can be seen in FIG. 3, the electromagnetic tripping member 44 of the circuit breaker is formed conventionally of a coil 75 inside which is mounted a core 76 for axial sliding. This latter is further articulated at 77 to a lever 78 mounted, at one of its ends, on a fixed pin $A_4$ and the other end of which is disposed bearing against an arch shaped piece 80 also forming a lever. This piece 80 is itself mounted at one of its ends in a fixed pin $A_5$ and its free end is arranged, via a ramp, facing an abutment stud disposed on the smae end of the lever as that coming to bear against the tripping piece 52.

At E in FIG. 3 has been shown a rotary isolating screen, known per se, intended to come between the contacts once they are open during a tripping procedure.

In this same FIG. 3, at 85*a*–85*d* have been illustrated the different conductors used for passing the electric current between the two terminals 41 and 42 of the case of the circuit breaker in the set position.

Figure 5:
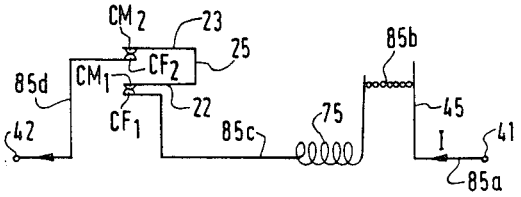
FIG. 5 shows the electric diagram of the circuit breaker of FIG. 3 showing the path of the electric current established between the terminals of the circuit breaker.

In greater detail, referring to FIG. 5, the path of current I established between the terminals 41 and 42 when the circuit breaker is set includes the conductor 85*a*, the bimetallic strip 45, the flexible conductor 85*b*, the winding of coil 75 of the electromagnetic tripper, the conductor 85*c*, the two pairs of contacts ($CF_1$–$CM_1$, $CF_2$–$CM_2$) with the connection between the two mobile contacts which is provided by the two arms 22 and 23 and plate 25 (FIG. 1) and conductor 85*d*.

It will be noted that in the case of a single pair of contacts, the mobile contact is then connected to the terminal 42 of the case through a flexible conductor.

With this current path, it is important to note that the electric current does not flow through the mechanism controlling the contacts, forming by the lock of the circuit breaker, and so in particular through the support piece properly speaking of the invention, which is particularly advantageous in so far as the correct operation of this mechanism is concerned.

The circuit breaker shown in FIG. 3 operates in the following way.

In the set position, FIG. 3, handle 68 occupies its left hand position in this Figure and the two mobile contacts are applied to the two fixed associated contacts under the force produced by the pin 50, in the direction of arrow $f_1$, on the spring blade 13 of the contact carrying piece 10. In addition, one of the ends of lever 54 bears on the shoulder 52*a* of the tripping piece 52 under the action of the spring not shown, whereas the other end of said lever is disposed with respect to the bimetallic strip 45 at a given distance D which is defined, as is known, as a function of the chosen value of the thermal tripping current.

For tripping the circuit breaker and causing the contacts to open, this will simply be explained for the case of the appearance first of all of an electric overload, then a short circuit, it being understood that tripping of the circuit breker may also be voluntary, manual or automatic.

When an electric overload appears, the bimetallic strip 45 undergoes a deflection of amplitude D towards lever 54 and forces this latter to pivot in a clockwise direction so as to free it from the shoulder 52*a* of the tripping piece 52. Once lever 54 is released from piece 52, and under the effect of the combined forces $f_2$ and of the reaction of $f_1$, lever 49 pivots in a clockwise direction about the bearing points 70*a* and 70*b* of the toggle mechanism 70.

This same pivoting lever 49 is also obtained in the case of the appearance of a short circuit in the following way.

The core 76 of the electromagnetic tripping coil undergoes a rectilinear movement in the direction of arrow $f_5$ in FIG. 3 and forces lever 78 to pivot in an anticlockwise direction. This latter then urges piece 80 whose free end moves upwards and comes into abutment against the stud mounted at the end of lever 54 for driving this latter out of the shoulder 52*a* of the tripping piece 52. Then, as before, lever 49 pivots in a clockwise direction about the bearing points on the toggle mechanism 70.

From this pivoting of lever 49, the rest of the procedure for tripping the circuit breaker will now be described which is just as valid in the case of an electric overload as in the case of a short circut, with reference to FIGS. 6 and 7.

Figure 6:
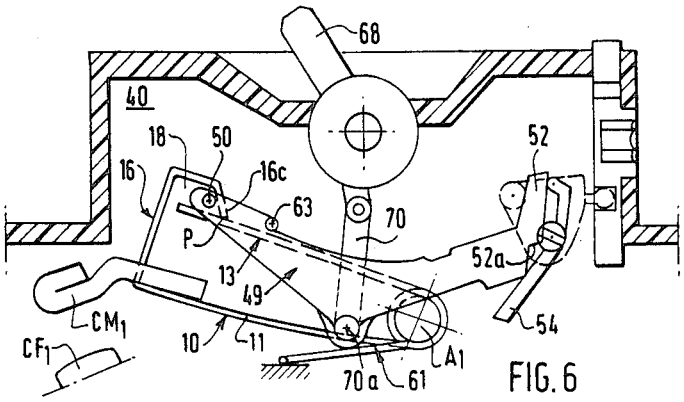
FIGS. 6 and 7 show in elevation a part of the circuit breaker of FIG. 3, respectively in an intermediate tripping position and in its final tripped position.

Thus, during pivoting of lever 49 in a clockwise direction, pin 50 thereof pivots in the same direction, which results in relaxing the spring blade 13 which comes into abutment at P on branch 16*c* for there occupying its rest position, as appears from FIG. 6 which shows an intermediate tripping position of the circuit breaker. At that time, the reaction to $f_1$ (FIG. 3) of the spring blade 13 is cancelled out, only the force $f_2$ contributes to pivoting the lever 49; pin 50 is therefore no longer bearing on the spring blade 13.

Then, continuing its pivoting in the space 18 defined as was seen in connection with FIG. 2, the pin 50 comes into abutment against the branch 16*c* of the contact carrying piece 10, as illustrated in FIG. 6, and then causes clockwise rocking of the contact carrying piece 10 abouts its axis $A_1$, which results in separating the two mobile contacts from their two fixed associated contacts (FIG. 6).

Thus, it can be said that the spring blade of the contact carrying piece of the invention allows the mobile contacts to open after release of the force produced by the pin of the lever on said spring blade.

It will be observed that during pivoting of lever 49, each of the bearing points of the toggle joint 70 moves in a guide slot formed in the case 40 of the circuit breaker.

Figure 8:
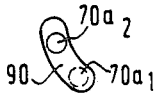
FIG. 8 shows a detail of the case of the circuit breaker.

FIG. 8 shows this slot 90, of a general oblong shape, in which the bearing point 70*a* moves for example to pass from a low position $70a_1$ when the circuit breaker is set to a high position $70a_2$ during tripping of the circuit breaker.

Figure 7:
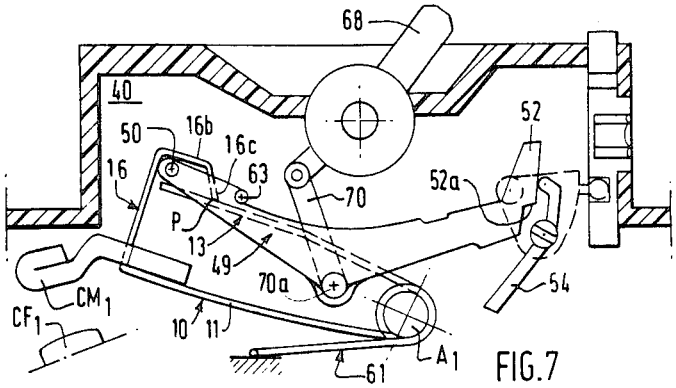

Thus, after going beyond the dead point of the toggle joint 70, and under the effect of its own assistance spring, handle 68 passes from the position shown in FIG. 6 to that shown in FIG. 7 which illustrates the final tripping position of the circuit breaker; the toggle joint 70 then causes lever 49 to lift whose pin 50, on opening of the contacts, slides over the bent bottom of branch 16*b* of the contact carrying piece 10 as is shown in FIG. 7.

After tripping on a fault, resetting is automatic; with the parts of the circuit breaker occupying the position shown in FIG. 7, the handle is brought leftwards, causing lever 49 to lower and to pivot in an anticlockwise direction; then, lever 54 takes up its position bearing against the shoulder of the tripping piece 52, whereas pin 50 exerts on the spring blade 13 a given downward force $f_1$ so as to apply, with the desired pressure, the two mobile contacts on their two fixed associated contacts.

Of course, the invention is in no wise limited to the embodiment described and shown and includes all the technical equivalents of the means described, as well as combinations thereof if they are effected in accordance with the spirit of the invention and used within the scope of the following claims.

What is claimed is:

1. A circuit-breaker operable under the effect of a current overload, said circuit-breaker including:

i. at least one stationary contact member and at least one movable contact member respectively having contact surface portions adapted for mutual engagement;

ii. a support member for the movable contact member, said support member having a rigid portion, said rigid portin having an outer face, a first end and a second end, and a resilient blade portion integrally conected together at a first end thereof through a cylindrical portion which is pivotally mounted about a stationary axis, the movable contact member being mounted at a second end of the rigid portion, the rigid portion further having at said second end an up-turned generally C-shaped tongue portion having a branch substantially parallel to said resilient blade portion and overlapping said blade portion whereby the support member forms a substantially closed loop defining an inner space, the contact surface portion of the movable contact member being located out of said inner space, said resilient blade portion being movable between a biased position and a released potion;

iii. tripping means for pivoting the support member about said stationary axis from said biased position of the resilient blade portion in which said contact surface portions are mutually engaged to said released position in which said contact surface portions are separated from each other and resetting means for pivoting the support member from the released position to the biased position;

iv. said tripping means comprising an elongate lever pivotally mounted about a displaceable axis, said axis being movable within said inner space from a first position to a second position, the first position being nearer from said rigid portion than the second position, said lever having at a first end thereof a pin adapted for engaging the resilient blade portion which projects between said resilient blade portion and said branch, said lever cooperating at a second end thereof with latching means releasable under the effect of said current overload, said latching means having a latch which has, relative to said lever, a released position in which said second end of the lever is freed and a latching position in which said second end of the lever is latched, said latch then forming a further pivoting axis for said lever, said tripping means further comprising spring means engaging on a surface portion of said lever which is located out of said inner space between said pin and said displaceable axis for pivoting the lever in a first direction about said displaceable axis when said displaceable axis is in its first position and the latch passes to its released position whereby the pin is disengaged from the resilient blade portion which then returns to its released position, the pin then abutting against said tongue;

v. said resetting means, in the released position of said latch, being operable through manual action to move said displaceable axis from its second to its first position and automatically returning said displaceable axis to its second position when no manual action is exerted thereon, the pin then sliding over said branch, said latching means further comprising means for moving the latch to the latching position when the current overload has disappeared, said lever, when said manual action is exerted for resetting the support member to its biased position pivoting about said displaceable axis in said first direction until the latch has recaptured the second end fo the lever and then pivoting about said further axis in a second direction opposite the first direction, whereby the pin engages the resilient blade portion which then is biased to its biased position.

2. A circuit-breaker is claimed in claim 1, wherein said tongue has a further inclined end branch portion extending said branch and against which said blade portion comes into abutment in its released position.

3. A circuit-breaker as claimed in claim 2, wherein said support member includes a stiffening molding extending longitudinally over said outer face of said rigid portion.

4. A circuit-breaker as claimed in claim 1, wherein the support member of said circuit-breaker comprises two substantially parallel arm shaped membres projecting in a longitudinal direction of said rigid portion on each side of said tongue, and connected transversely to each other by an electrically conducting plate fixed to said rigid portion.

5. A circuit-breaker as claimed in claim 4, wherein said contact members and said plate form one piece made of an electrically conducting material.

6. A circuit-breaker operable under the effect of a current overload, said circuit-breaker including:

i. at least one stationary contact member and at least one movable contact member respectively having contact surface portions adapted for mutual engagement;

ii. a support member for the movable contact member, said support member having a resilient blade portin movable between a biased position and a released position;

iii. tripping means for pivoting the support member from said biased position of the resilient blade portion in which said contact surface portions are mutually engaged to said released position in which said contact surface portions are separated from each other and resetting means for pivoting the support member from the released position to the biased position;

iv. said tripping means comprising an elongate lever pivotally mounted about a displaceable axis which is movable from a first position to a second position, said lever having at a first end thereof a pin adapted for engaging the resilient blade portion, said lever cooperating at a second end thereof with latching means releasable under the effect of said current overload, said latching means having a latch which has, relative to said lever, a released positin in which said second end of the lever is freed and a latching position in which said second end of the lever is latched, said latch then forming a further pivoting axis for said lever, said tripping means further comprising spring means engaging on a surface portion of said lever which is located between said pin and said displaceable axis for pivoting the lever in a first direction about said displaceable axis when said displaceable axis is in its first position and the latch passes to its released position whereby the pin is disengaged from the resilient blade portion which then returns to its released position;

v. said resettting means, in the released position of said latch, being operable through manual action to move said displaceable axis from its second to its first position and automatically returning said displaceable axis to its second position when no manual action is exerted thereon, said latching means further comprising means for moving the latch to the latching position when the current overload has disappeared, said lever, when said manual actionis exerted for resetting the support member to its biased position, pivoting about said displaceable axis in said first direction until the latch has recaptured the second end of the lever, and then pivoting about said further axis in a second direction opposite the first direction, whereby the pin engages the resilient blade portion which then is biased to its biased position.

* * * * *